US005097815A

United States Patent [19]

Oota et al.

[11] Patent Number: 5,097,815

[45] Date of Patent: Mar. 24, 1992

[54] IGNITION SYSTEM FOR INTERNAL COMBUSTION ENGINE

[75] Inventors: Nobuyuki Oota, Kariya; Yasutoshi Yamada, Chita; Motonobu Akagi, Anjo, all of Japan

[73] Assignee: Aisin Seiki K.K., Aichi, Japan

[21] Appl. No.: 592,102

[22] Filed: Oct. 3, 1990

[30] Foreign Application Priority Data

Oct. 3, 1989 [JP] Japan ..... 1-258305

[51] Int. Cl.[5] ..... F02P 3/05

[52] U.S. Cl. ..... 123/606; 123/644; 315/209 T

[58] Field of Search ..... 123/606, 607, 637, 644, 123/621; 315/209 T

[56] References Cited

U.S. PATENT DOCUMENTS

| | | | |
|---|---|---|---|
| 3,035,108 | 5/1962 | Kaehni | 123/606 |
| 3,892,219 | 7/1975 | Preiser et al. | 315/209 T |
| 4,356,807 | 11/1982 | Tokura et al. | 123/606 |

FOREIGN PATENT DOCUMENTS

| | | | |
|---|---|---|---|
| 2734034 | 2/1978 | Fed. Rep. of Germany | 123/621 |
| 64-15464 | 1/1989 | Japan | 123/606 |
| 64-63658 | 3/1989 | Japan | 123/621 |

*Primary Examiner*—Andrew M. Dolinar
*Attorney, Agent, or Firm*—Sughrue, Mion, Zinn, Macpeak & Seas

[57] ABSTRACT

An ignition system is disclosed in which secondary windings of a first and a second ignition coil are connected in parallel to a spark electrode of an internal combustion engine. A d.c. high voltage is alternately fed to the primary windings of the first and the second ignition coil. When an integrated value of a current flow through the first (the second) ignition coil reaches a first reference value, this primary coil is disconnected from a feed bus, and instead the primary winding of the second (the first) ignition coil is connected to the bus. When a short-circuit occurs in one of the ignition coils, only the other ignition coil conducts repeatedly, and accordingly the switching of the energization takes place whenever the current flow through the first (the second) ignition coil reaches a second reference value. In the event a breakage occurs in one of the ignition coils, only the other ignition coil conducts repeatedly, and accordingly the switching of the energization takes place when the integrated value of the current flow through the first (the second) ignition coil fails to reach the first reference value within a first given time interval.

6 Claims, 4 Drawing Sheets

IGNITION SYSTEM FOR INTERNAL COMBUSTION ENGINE

FIELD OF THE INVENTION

The invention relates to an ignition system for internal combustion engine, and in particular, to an ignition system of a type which produces spark discharges repeatedly across spark electrodes during an ignition period.

BACKGROUND OF THE INVENTION

An ignition system is proposed in the prior art which produces spark discharges repeatedly, rather than a single spark discharge, during an ignition period in order to increase the probability of allowing a fuel to be ignited, and is disclosed, for example, in Japanese Laid-Open Patent Applications No. 58,430/1975 and No. 28,871/1982. The ignition system disclosed in Japanese Laid-Open Patent Application No. 58,430/1975 assures the ignition of the fuel by increasing the chance that a fuel can be ignited, essentially by continuously repeating spark discharges during an ignition period. However, the supply and the delivery of appropriate amount of ignition energy is not always assured if the ignition takes place at a given time interval, due to a fluctuation in the secondary current of an ignition coil which is attributable to discharge phenomena occurring at the spark electrodes, variations in the response of ignition plugs during the manufacturing process or a variation from internal combusion engine to engine.

In the ignition system disclosed in Japanese Laid-Open Patent Application No. 28,871/1982, both the primary and the secondary current of an ignition coil are detected, and the on/off timing of the primary current is controlled in a manner corresponding to the actual current flow through the secondary winding to assure a secondary current of a given magnitude, thereby achieving a stabilized multiple ignition. However, the on/off control of the primary current through the detection of the secondary current present difficulties in its practical use because of the voltage withstanding capability which is required in detecting the high voltage across the secondary circuit. In addition, in an arrangement which performs a multiple ignition, it is necessary to provide an increased pause interval between repeated spark discharges in order to secure a sufficient amount of discharge energy. In addition, disturbances may be caused in the waveform of the discharge current of respective single sparks depending on conditions which prevail within a combustion chamber, and accordingly even a multiple ignition (repeated spark discharges) is not sufficient to assure an ignition with high energy.

CROSS-REFERENCE TO RELATED PATENT APPLICATION

The invention represents modifications of an invention entitled "Ignition Control System" in pending U.S. Pat. application Ser. No. 511,231, filed Apr. 19, 1990 by the present inventors, but discloses and claims different concepts.

SUMMARY OF THE INVENTION

The invention has for its first object the stabilization of discharge energy for repeated sparks and feeding high energy to a spark electrode during an ignition period, and has for its second object to feed discharge energy to a spark electrode even in the occurrence of a short-circuit or breakage in one of ignition coils.

The first object is accomplished by a high energy ignition system for internal combustion engine according to the invention, comprising a plurality of ignition coils (5, 6) having one end of respective primary windings connected to a feed bus (4) and having their secondary windings connected in parallel with a spark electrode (7); a plurality of switching means (8, 9) for turning on or off the primary circuits of the respective ignition coils (5, 6); on command means (20) for applying an on command signal to the switching means (8, 9) selectively and sequentially in a cyclical manner; integrating means (Cl) for integrating a current flow which is used to energize the primary winding of the respective ignition coils (5, 6); and timing control means (12, 33, 34, 14, 15) operative, when an integrated value (Wi) by the integrating means (Cl) exceeds a preset value (Ws), to issue an off command applied to the on command means (20), followed by a next on command also applied to the on command means (20) while resetting the integrated value (Wi) by the integrating means (Cl), at a timing such that while a discharge current is fed to the spark electrode (7) from one of the ignition coils (5/6), the switching means (9/8) connected to the primary winding of the other ignition coil (6/5) is turned on and off. In the above description, numerals or characters appearing in parentheses correspond to numerals or characters used in the description of an embodiment to be described later in connection with the drawings.

According to the invention, when the timing control means (12, 33, 34, 14, 15) issues an on command, the on command means (20) turns one of the switching means (8, 9), for example, 8, on, whereby a charging current begins to flow through the primary winding of one of the ignition coils, (5), and the magnitude of the current flow increases gradually. In the meantime, the integrated means (Cl) integrates the charging current. When the integrated value (Wi) exceeds the preset value (Ws), the timing control means (12, 33, 34, 14, 15) issues an off command applied to the on command means (20), whereby the charging current ceases to flow through the ignition coil (5), whereupon a discharge current flows through the secondary coil of the ignition coil (5).

It will thus be seen that the power supplied to the single ignition coil (5) during one charging cycle remains constant, so that the power applied to the spark electrode (7) will assume a stable value corresponding to the preset value (Ws).

The timing control means (12, 33, 34, 14, 15) is operative to issue an off command applied to the on command means (20), followed by an on command applied to the on command means (20) while resetting the integrated value (Wi) by the integrating means (Cl) when the integrated value (Wi) from the integrating means (Cl) exceeds the preset value (Ws) at a timing such that while one of the ignition coils, (5), feeds a discharge current to the spark electrode (7), the switching means (9) connected to the primary winding of the other ignition coil (6) begins to be turned on and completes its turn-off during such interval. Accordingly, as described above, the primary coil of the ignition coil (5) is initially charged, and during the discharge of the ignition coil (5) when the charging has ceased or while its secondary winding feeds a discharge current to the spark electrode (7), the on command means (20) turns the switching means (9) on, whereby the charging current begins to flow through the primary winding of the ignition coil (6). This charging current is integrated by the integrating means (Cl), and when the integrated value (Wi) exceeds the preset value (Ws), the switching means (9) is turned off, whereupon the secondary winding of the ignition coil (6) begins to discharge through the spark electrode (7). Then the charging of the ignition coil (5) is initiated again, and the discharge of the ignition coil (5) is initiated during the time the ignition coil (6) continues its discharge.

Thus it will be seen that the discharge current is fed to the spark electrode (7) in a time sequence from sequential ones of the plurality of ignition coils (5, 6) such that prior to the discharge current from the preceding coil is interrupted, the discharge from the succeeding coil is initiated. Accordingly, the spark electrode (7) continuously maintains a spark discharge without any interruption, and the discharge current maintains a high magnitude, producing a stabilized and high discharge energy during the ignition period.

In the event a short-circuit or leakage across winding wires occurs in the primary windings of the ignition coils (5, 6), the current flow through the primary winding will be excessive in magnitude while a discharge current through the secondary winding will be reduced. In particular, when the primary winding is designed to allow a charging current of a relatively high magnitude therein in order to increase the spark energy, a trouble such as burnout of the ignition coils (5, 6) may be caused. Thus it is desirable to avoid the energization of the coils with an excessive current. When the plurality of ignition coils discharge in a sequential manner as described above, it is preferred to continue the supply of discharge energy to the spark electrode (7) in the event a short-circuit in the primary winding of one of the ignition coils happens, by repeating the charging and discharge cycle of the remaining non-defective ignition coil or coils while avoiding the use of the short-circuited coil, even though this may reduce the discharge energy.

To cater for this, in a first embodiment of the invention (see FIG. 1), the timing control means (12, 33, 34, 14, 15, 11, 13) is operative to issue an off command applied to the on command means (20), followed by a next on command applied to the on command means (20) while resetting the integrated value (Wi) by the integrating means (Cl), when the current flow ($I_{51}$, $I_{61}$) of the respective primary windings exceeds a preset value (Ias).

With this arrangement, in the event a short-circuit or leakage occurs in the primary winding of one of the ignition coils, (5), for example, as the switching means (8) connected to this coil is turned on, there occurs a current flow of a relatively high magnitude through the primary winding of the ignition coil (5), and in response thereto, the timing control means (12, 33, 34, 14, 15, 11, 13) is operative to issue an off command applied to the on command means (20), followed by a next on command (for the switching means (9)) which is also applied to the on command means (20) while resetting the integrated value (Wi) by the integrating means (Cl). Accordingly, the switching means (8) is immediately turned off, precluding the charging current to be supplied to the ignition coil (5). The switching means (9) is turned on in interlocked relationship therewith. Even though the spark electrode (7) then ceases to discharge, as the ignition coil (6) is charged to a given level and the integrated value (Wi) exceeds the preset value (Ws), the switching means (9) is turned off, whereuopn the ignition coil (6) discharges through the spark electrode (7). This discharge continues until the switching means (9) is turned on again. In other words, a discharge from the spark electrode (7) occurs during a delay time ($T_3$) which is present until the next on command is applied to the on command means (20) since the off command is initially applied to the on command means (20). Isolated or non-consecutive spark discharges occur repeatedly at the spark electrode (7) with a time period which is substantially equal to the delay time ($T_3$) plus the charging interval (which means the time interval from the initiation of the energization of the primary winding of the ignition coil (6) until the integrated value (Wi) reaches the preset value (Ws)), thus continuing the occurrence of spark discharges even though this may somewhat reduce the probability of causing the fuel to be ignited.

The on command means (20) is controlled by an on command which is issued whenever the integrated value (Wi) by the integrating means (Cl) exceeds the preset value (Ws). However, a breakage in the primary coil or a failure of the switching means may prevent a current flow through the coil and may thus prevent the integrated value (Wi) from changing or ever reaching the preset value (Ws). In such instance, the spark discharges cannot occur for an open-circuit failure of a single primary coil or switching means even though other primary coil or coils and other switching means may continue to operate in a normal manner.

To accommodate for this, in a second embodiment of the invention (see FIG. 3), the timing control means (11, 12, 13, 14, 15, 40) is further operative to issue a next on command to be applied to the on command means (20) if the integrated value (Wi) by the integrating means (Cl) fails to exceed the preset value (Ws) within a given time interval (Tll).

With this arrangement, if a breakage occurs in the primary winding of one of the ignition coils, for example, (5), there is no current flow through the primary winding of this ignition coil (5) even if the switching means (8) which is connected thereto is turned on. Accordingly, the integrated value (Wi) fails to reach the preset value (Ws), and after the given time interval (Tll), the timing control means (12, 14, 15, 11, 13, 40) issues a next on command for the other switching means (9) which is applied to the on command means (20). As a consequence, the other switching means (9) initiates the charging of the other ignition coil (6) after the given time interval (Tll) even though the integrated value (Wi) fails to reach the preset value (Ws).

As the ignition coil (6) is charged and the integrated value (Wi) exceeds the preset value (Ws), the switching means (9) is turned off and the ignition coil (6) discharges through the spark electrode (7). It will be noted that the discharge is maintained until the switching means (9) is turned on to initiate another charging operation for the next time. Roughly stated, isolated or non-consecutive spark discharges repeatedly occur at the spark electrode (7) with a period equivalent to the given time interval (Tll) which passes between the off command applied to the on command means (20) and the next on command which is also applied to the on command means (20). In this manner, the occurrence of spark discharges is maintained even though the chance that the fuel becomes ignited may be lowered.

Other objects and features of the invention will become apparent from the following description of embodiments thereof with reference to the drawings.

DESCRIPTION OF PREFERRED EMBODIMENTS

First Embodiment

Figure 1:
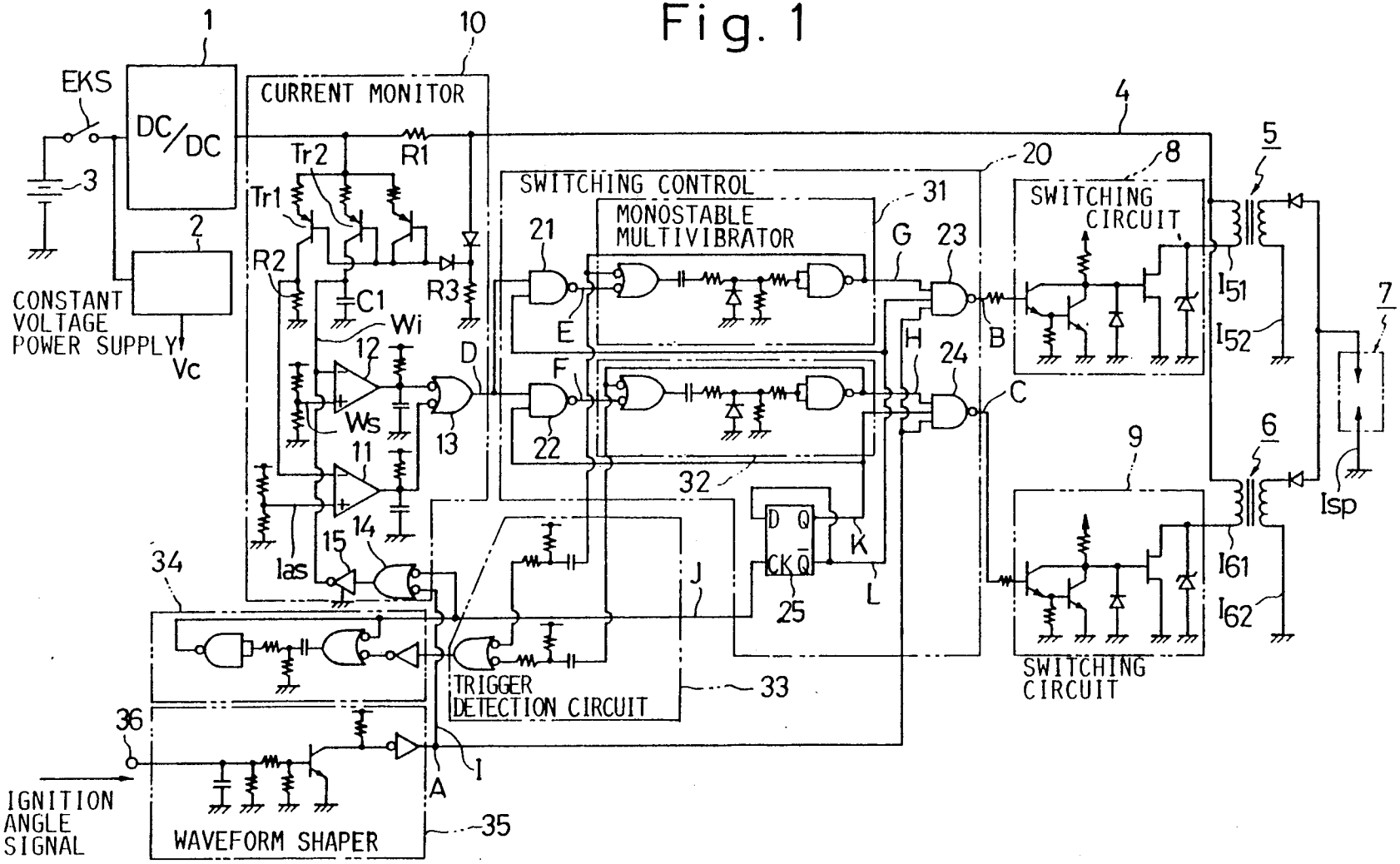
FIG. 1 is a circuit diagram of a first embodiment of the invention.

Referring to FIG. 1 which shows a first embodiment of the invention, a spark plug 7 is connected to the secondary windings of a pair of ignition coils 5 and 6 through diodes, not designated. The primary windings of the ignition coils 5 and 6 have their one end connected to a feed bus 4 while the other ends are connected to respective switching circuits 8 and 9.

The feed bus 4 is connected to the output terminal of a DC/DC converter 1 through a current monitor circuit 10. The converter has an input terminal which is connected through an engine key switch EKS, which is closed when the key switch is thrown to its engine run position, to the positive terminal of an onboard battery 3. In order to perform the charging of the ignition coils 5 and 6 at high rate and to increase the charging energy, the converter 1 boosts the battery voltage before feeding it to the feed bus 4. Also connected to the onboard battery 3 is an input terminal of the constant voltage power supply circuit 2 through the switch EKS. The power supply circuit 2 feeds various parts of the electrical circuit shown in FIG. 1 with required constant voltages.

Each of the switching circuits 8 and 9 is turned on when a signal B or C which is applied to its input assumes a low level L, connecting the other end of the primary coil of the ignition coil 5 or 6 to the electrical ground, thus allowing a charging current to pass through the primary winding. When the signal B or C assumes its high level H, the switching circuit is turned off, thus interrupting the current flow through the primary winding.

The current monitor circuit 10 includes a current mirror circuit formed by transistors Tr1, Tr2 and resistor R3 for passing a current flow which is proportional to a voltage drop across a resistor R1 having a low resistance and interposed between the output terminal of the converter 1 and the feed line 4 or representing a charging current through either ignition coil 5 or 6 to an integrating capacitor Cl and a current detecting resistor R2. A voltage Wi proportional to the magnitude of the charging current passing through the primary winding of either ignition coil 5 or 6 is developed across the integrating capacitor Cl, and a voltage also proportional to the charging current is developed across the resistor R2. These voltages are applied to the inverting input terminals of comparators 12 and 11, respectively.

Preset values or reference voltages Ws and Ias are applied to the non-inverting input terminals of the comparators 12 and 11, respectively, and hence the comparator 12 delivers an output of a high level H for an integrated value Wi of the charging current which is equal to or below the preset value Ws and delivers an output of a low level L when the integrated value Wi exceeds the preset value Ws. The comparator 11 delivers an output of a high level H when the level of the charging current through the primary winding of either ignition coil 5 or 6 is equal to or below the preset value Ias, and delivers an output of a low level L when the level exceeds the preset value Ias.

The output signals from these comparators 12 and 11 are applied to inputs of NOR gate 13, the output signal D of which remains at its low level L as long as the integrated value Wi of the charging current ($I_{51}$ or $I_{61}$) of either ignition coil 5 or 6 is equal to or below the preset value Ws and the charging current ($I_{51}$ or $I_{61}$) is equal to or below the preset value Ias. However, the output signal D changes to a high level H when the integrated value Wi exceeds the preset value Ws or when the charging current ($I_{51}$ or $I_{61}$) exceeds the preset value Ias.

The current monitor circuit 10 includes NOR gate 14 which receives an ignition angle signal A and an output signal J from a monostable multivibrator 34 as inputs. The angle signal A represents an ignition command when it is at a high level and represents the absence of such command when it is at its low level. The output signal J from the multivibrator 34 remains at its low level for a time interval $T_3$ after it is triggered, but assumes a high level otherwise. When at least one of the signals A and J assumes its L level, the gate 14 produces an output of high level, whereby the output of an inverter 15, which is connected to the output of the gate 14, is connected to the electrical ground, thus causing the integrating capacitor Cl to discharge or resetting it.

The output signal D from the gate 13 in the current monitor circuit 10 is applied to one input of each of NAND gates 21 and 22 in a switching control circuit 20. In the control circuit 20, when an output signal E from the gate 21 changes from its H to its L level, a monostable multivibrator 31, which operates to detect the falling edge, operates to produce a pulse signal G of a low level and having a given short width in response thereto, which is applied to an output gate or NAND gate 23. When an output signal F from the gate 22 changes from its H to its L level, a monostable multivibrator 32, which also functions to detect the falling edge, produces a pulse signal H of a low level and having a short width, which is applied to an output gate or NAND gate 24. The gates 23 and 24 additionally receive a Q output signal K and its inverted signal L from a flipflop 25, respectively, and also receive the ignition angle signal A. The signals K and L from the flipflop 25 are also applied to the input gates or NAND gates 21 and 22, respectively.

Accordingly, in response to the rising edge of the signal D to its H level or when the integrated value Wi of the charging current exceeds the preset value Ws or when the magnitude of the charging current exceeds the preset value Ias, one of the output signals E and F from the gates 21 and 22 changes to its L level, thus triggering the corresponding multivibrator 31 or 32. The signals E and F are also applied to NOR gate in a trigger detection circuit 33, and when at least one of the signals E and F assumes an L level, which means a trigger command signal, an output from the gate in the trigger detection circuit 33 assumes its H level, which in turn triggers a monostable multivibrator 34 which is used as a timer.

When triggered, the multivibrator 34 produces a signal J which remains at its L level for a time interval $T_3$ after it is triggered and assumes an H level otherwise. The signal J is applied to the gate 14 in the current monitor circuit 10 as mentioned previously and is also applied to the flipflop 25 in the switching control circuit 20. In response thereto, the gate 24 resets an integrated value formed by the capacitor Cl while the flipflop 25 is inverted, simultaneously inverting the signal levels of the signals K and L.

Such inversion of the flipflop 25 is effective to change the particular gate from which an on output command is delivered. Specifically, if the signal K assumes an L level while signal L assumes an H level, causing the output gate 23 to deliver an on output and causing the input gate 21 to provide an on input, the inversion causes the output gate 24 to deliver an on output and causes the input gae 22 to provide an on input.

The purpose of a waveform shaper 35 is to amplify the ignition angle signal, which is oncoming at an input terminal 36 and commanding an ignition with its H level and indicating the absence of such ignition command with its L level, to shape its waveform so that its rising and falling edge is sharply defined, and to convert the signal level to those signal levels which are optimum to the current monitor circuit 10 and the switching control circuit 20.

Figure 2:
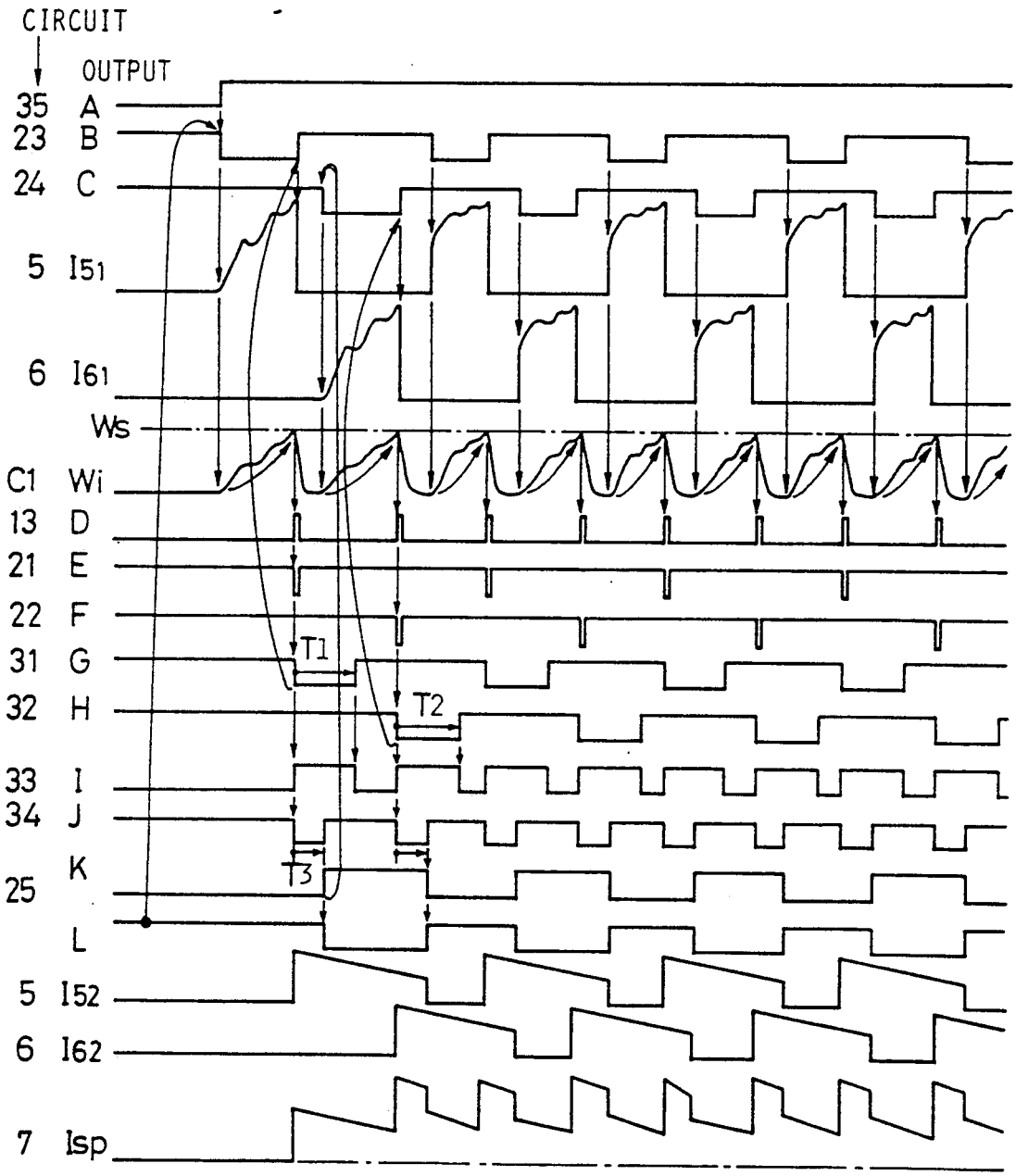
FIG. 2 is a series of timing charts illustrating signals appearing in various parts of the electrical circuit shown in FIG. 1 as a time sequence.

FIG. 2 shows changes in the electrical signals which appear at various points in the electrical circuit shown in FIG. 1, against a common time axis which is taken on the abscissa. It is to be noted that an arrow shown in FIG. 2 indicates a relationship between a change in a signal, located at the root of the arrow, and a change in another signal, located at the tip of the arrow, which is produced in response thereto. The operation of the electrical circuit shown in FIG. 1 will be understood by following the progression of arrows, starting with the left-most one.

Referring to the progression of arrows shown in FIG. 2, the operation of the circuit shown in FIG. 1 will now be described. Assuming that the engine key switch EKS is closed, if the ignition angle signal A is at its L level, indicating the absence of an ignition command, the outputs B and C from the gates 23 and 24 in the switching control circuit 20 will be both high due to the signal A=L, regardless of the set or reset condition of the flipflop 25, resulting in the both switching circuits 8 and 9 being turned off. Thus neither ignition coil 5 nor 6 will be energized. Assume now that the flipflop 25 is reset, meaning that the signal K=L and the signal L=H, and the ignition angle signal A rises from its L to its H level. (1) The output B from the gate 23 will change to its L level, whereby the switching circuit 8 is turned on, causing a charging current $I_{51}$ to pass through the primary winding of the ignition coil 5, allowing the current level to increase gradually. A current flow which is proportional to the charging current $I_{51}$ is integrated by the capacitor Cl. When the integrated value exceeds the preset value Ws, an output from the comparator 12 changes from its H to its L level, whereby the output signal D from the gate 23 rises from its L to its H level. In response thereto, the gate 21 delivers an inverted signal E, which triggers the multivibrator 31, with its output signal G falling from its H to its L level. This output signal is transmitted through the trigger detection circuit 33 to trigger the vibrator 34, the output J of which falls from its H to its L level, and the resulting signal of low level is applied to the gate 14, causing the capacitor Cl to be discharged through the inverter 15. As a consequence of the output G from the multivibrator 31 which now assumes a low level, the output B from the gate 23 rises from its L (on command) to its H (off command) level, thus turning the switching circuit 8 off to interrupt the charging current through the primary winding of the ignition coil 5. Thereupon, a high voltage is induced across the secondary winding of the coil, producing a spark discharge at the spark plug 7, causing the discharge current to flow through the plug 7.

As the capacitor Cl discharges, the output of the comparator 12 returns from its L to its H level, and the signal D also returns to its L level. However, the output G from the multivibrator 31 remains at its low level for the time interval $T_1$, and hence the switching circuit 8 is maintained off. In the meantime, the multivibrator 34 completes the time limiting action at the end of the time interval $T_3$, thus returning its output J to its H level.

In response to the rising edge of the signal J from its L to its H level, the flipflop 25 is inverted, thus changing its output K to its H level and its output L to its L level. Accordingly, the output B from the gate 23 remains unchanged at its H level (switch off). (2) The output C from the gate 24 changes from its H level to its L (switch on) level, to turn the switching circuit 9 on, whereby the charging current $I_{61}$ begins to flow through the primary winding of the ignition coil 6 and continues increasing. The charging current $I_{61}$ is integrated by the capacitor Cl. When the integrated value exceeds the preset value Ws, the output from the comparator 12 reverts from its H to its L level, whereby the output signal D from the gate 13 rises from its L to its H level and its inverted signal F is delivered by the gate 22 to trigger the multivibrator 32. The output signal H of the multivibrator falls from its H to its L level, and is transmitted through the trigger detection circuit 33 to trigger the multivibrator 34, whereby its output J changes from its H to its L level, causing the gate 14 to operate upon the inverter 15 to cause a discharge of the capacitor Cl. As a result of the output H from the multivibrator 32 being low, the output B from the gate 24 rises from its L (on command) level to its H (off command) level, turning the switching circuit 9 off to interrupt the flow of the charging current through the primary winding of the ignition coil 6, whereupon a high voltage is induced across the secondary winding thereof to produce a discharge current through the spark plug 7.

As a result of the discharge of the capacitor Cl, the output of the camparator 12 returns from its L to its H level, whereby the signal D returns to its L level. However, since the output H from the multivibrator 32 remains at its L level for the time interval $T_2$, the switching circuit 9 is maintained off. In the meantime, the time limiting action of the multivibrator 34 for the time interval $T_3$ is completed, whereupon its output J returns to its H level.

In response to the signal J rising from its L to its H level, the flipflop 25 is inverted, changing its output K to its L level and its output L to its H level. While the output C from the gate 24 remains at its H level (switch off), the output B from the gate 23 changes from its H to its L (switch on) level, thus continuing to the operation described above under the paragraph (1). Subsequently, as long as the ignition angle signal A remains at its H level, a sequence of operations denoted by the procedures (1)-(2)-(1)-(2)—and the alternate charging of the ignition coils 5 and 6 are repeated.

When the ignition angle signal A returns to its L level (no ignition), both gates 23 and 24 are disabled, and the outputs B and C both assume their H level, turning the switching circuits 8 and 9 off. This ceases the energization of either ignition coil 5 or 6. In addition, the output from the gate 14 assumes its H level, whereby the capacitor Cl is connected to the electrical ground or the integrated value is reset.

It is to be noted that while the ignition coils 5 and 6 are of a relatively compact size and the discharge period from the secondary winding as counted from the interruption of the charging operation is of a relatively short duration, the booster action by the converter 1 combined with a high rate and a high voltage of the charging is effective to provide a relatively high level of charging energy per cycle, which is sufficient to feed a discharge current continuously to the spark plug from the secondary winding of the ignition coil during the time interval while the other ignition coil undergoes a pause between the repeated charging operations thereof. In addition, during the pause interval of one of the ignition coils during which its discharge occurs, the charging of the other ignition coil is completed in preparation to the initiation of the discharge, so that the current flow to the spark plug 7 from the secondary windings of the ignition coils 5 and 6 will be as shown at $I_{52}$ and $I_{62}$ in FIG. 2, which are combined to provide a continuous or uninterrupted current flow to the spark plug as indicated at Isp in FIG. 2.

Continuing the description of the operation of the electrical circuit shown in FIG. 1, in the event a short-circuit across the terminals or between winding wires or a leak therebetween occurs in the primary winding of the ignition coil 5, it will be noted that as the operation described by the procedure (1) proceeds, when the magnitude of the current exceeds the preset value Ias as a result of the short-circuit or leakage, the output from the comparator 11 changes from its H to its L level, triggering the multivibrator 20 to turn the switching circuit 8 off, which then inverts the flipflop 25 causing the system to transfer to the operation described by the procedure (2), in the similar manner as when the integrated value Wi across the capacitor Cl has exceeded the preset value Ws. In other words, as soon as the operation described by the procedure (1) is entered, the operation immediately transfers to that described by the procedure (2), so that substantially no charging current is fed to the ignition coil 5. In such instance, denoting the charging period per cycle of the ignition coil 6 by Tc, it will be seen that only the ignition coil 6 will discharge to the spark plug 7 with a period which is substantially equal to $T_3+Tc$. Thus, isolated spark discharges with pauses therebetween are repeated, and the discharge period per cycle will be substantially equal to $T_3$.

It is to be understood that logic circuit elements which follow the comparator 11 in the current monitor circuit 10, the switching control circuit 20, the trigger detection circuit 30, and the multivibrator 34 may be entirely replaced by a single or a plurality of microprocessors functionally.

Second Embodiment

Figure 3:
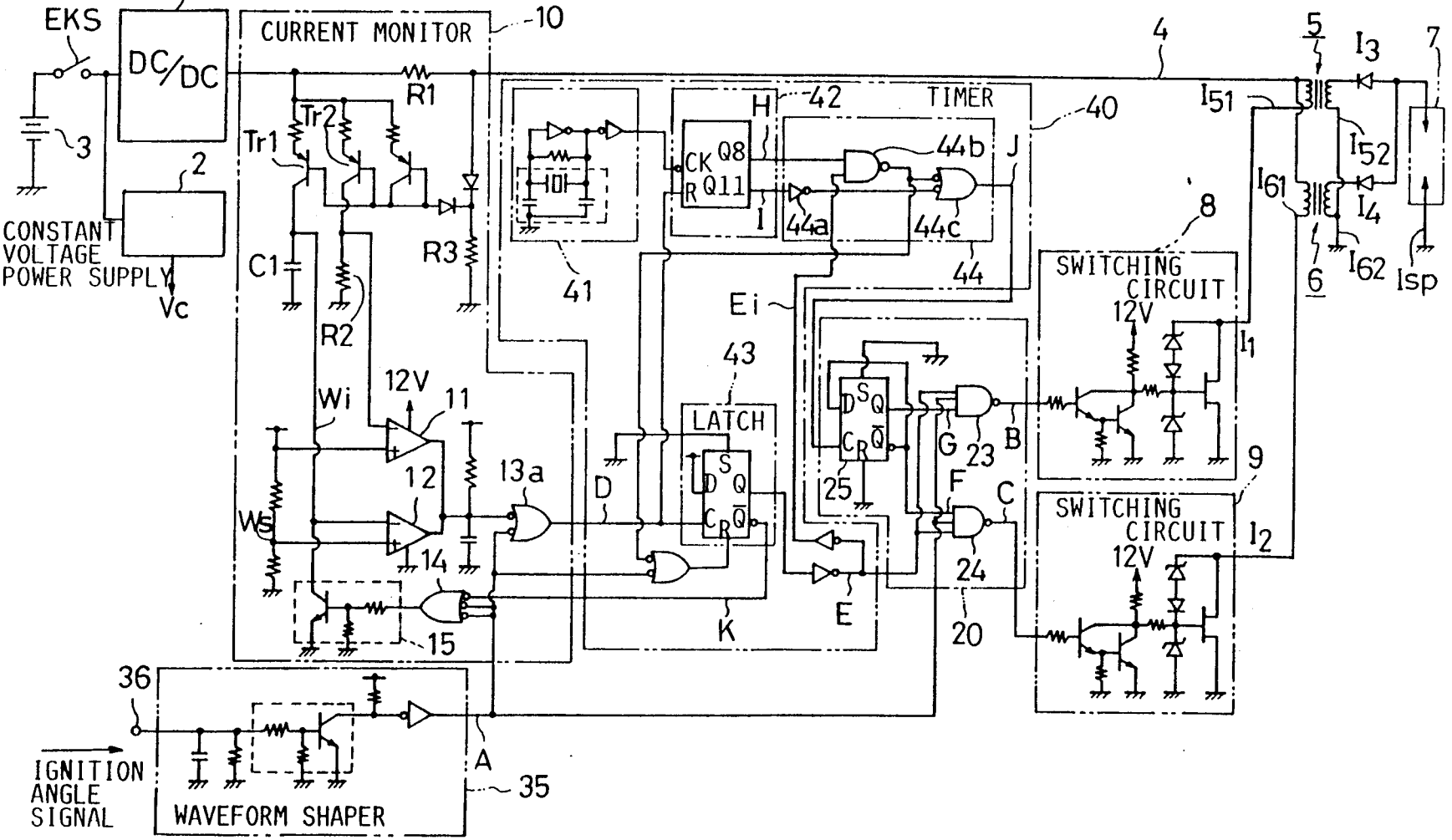
FIG. 3 is a circuit diagram of a second embodiment of the invention.

Referring to FIG. 3 which shows a second embodiment of the invention, the spark plug 7 is connected to the secondary windings of the pair of ignition coils 5 and 6 through respective diodes $I_3$ and $I_4$. The primary windings of these ignition coils 5 and 6 have their one end connected to the feed bus 4 while the other end is connected to the switching circuits 8 and 9, respectively.

The feed bus 4 is fed from the converter 1 as mentioned above in connection with the first embodiment. As before, the converter 1 is in turn fed from the on-board battery 3, which cooperates with the power supply circuit 2, mentioned previously. The construction and the operation of the switching circuits 8 and 9 remains the same as before. The current monitor circuit 10 is constructed generally in the similar manner as the current monitor circuit shown in FIG. 1 except that the integrating capacitor Cl is connected in series with the transistor Tr1 and the current detecting resistor R2 is connected in series with the transistor Tr2. In addition, instead of using separate voltage dividers to supply reference values to the non-inverting inputs of the comparators 11 and 12, such reference values are derived from a common voltage divider in the arrangement of FIG. 3. As other modification, the outputs from the comparators 11 and 12 are coupled together to feed one input of NOR gate 13*a* rather than feeding separate inputs thereof. However, the operation remains the same as before.

The gate 13*a* is also fed with the ignition angle signal A, and in the absence of the ignition angle signal input, the output of the gate 13*a* remains unchanged at its H level. In response to the input of the ignition angle signal, its output changes to its L level, and then changes to its H level when the preset value is exceeded. The output signal D from the gate 13*a* is applied to the clock terminal C of a latch circuit 43 (flipflop) in a timer circuit 40 and to a reset terminal R of a frequency divider circuit 42.

NOR gate 14 in the current monitor circuit 10 includes three inputs rather than two inputs as in the first embodiment, and receives the ignition angle signal A, and an output signal K from the latch circuit 43. The angle signal A represents an ignition command at its H level and represents a no ignition command at its L level. When at least one of the signals A and K is low, the output from the gate 14 is high to turn a transistor in the inverter 15 on, connecting the integrating capacitor Cl to the electrical ground to reset the integrated value thereof.

The timer circuit 40 includes an oscillator circuit 41, the frequency divider circuit 42, the latch circuit 43 and a timer switching output circuit 44. The output circuit 44 comprises an inverter 44*a*, NAND circuit 44*b* and NOR circuit 44*c*, the output of which represents a final output from the output circuit 44.

The oscillator circuit 41 is formed by a quartz oscillator, and its output is applied to the clock terminal CK of the frequency divider circuit 42. The latter delivers two outputs Q8 and Q11 having different periods on the basis of the clock defined by the output of this oscillator circuit 41. It is to be noted that the time intervals T8 and Tll which are required until the outputs Q8 and Q11 are delivered since the frequency divider circuit 42 is reset are related such that $T8+Tc<T11$, where Tc represents the coil charging interval.

The latch circuit 43 is triggered to its H level in response to the rising edge of an output from the gate 13*a* or the clock signal, and is reset to its L level in response to a high level output Q8 from the frequency divider circuit 42. In other words, the output from the gate 13*a* is latched until the output Q8 is delivered from the frequency divider circuit 42.

The timer switching output circuit 44 delivers an output signal J to the switching control circuit 20 as an output from the timer circuit 40. The signal J is obtained by NORing a NAND output formed by an output Ei of the latch circuit 43 and the output Q8 of the frequency divider circuit 42, and a NOT output of a signal I or the output Q11 from the frequency divider circuit 42. In other words, after the signal D of H level is delivered from the current monitor circuit 10, the signal E which represents the output from the latch circuit 43 is at its H level, so that the timer switching output J changes to its H level when the output Q8 assumes its H level.

Normally, the signal D of H level for the next cycle or a reset signal is produced before a high level output is delivered from Q11 of the frequency divider circuit 42, and hence the signal I which represents Q11 output is maintained low. However, in the event of an open-circuit abnormality which prevents a current flow through the primary winding and hence no signal D of H level is developed, the reset signal D of H level cannot be input to the frequency divider circuit 42 while the output Ei from the latch circuit 43 remains low, preventing Q8 from assuming its H level. Accordingly, NOR gate 44*c* delivers Q11 output of H level. Thus, upon occurrence of an abnormality such as an open-circuit due to a breakage in the coil, Q11 is effective to produce a timer switching output J of H level, which inverts the flipflop 25.

In the switching control circuit 20, NOT output signal E from the latch circuit 43, Q output signal G and its inverted signal F from the flipflop 25 and the ignition angle signal A are applied to NAND gates 23 and 24. The flipflop 25 is inverted in response to the output J of H level from the timer switching output circuit 44, whereby the outputs B and C, one of which assumes an H level and the other a low level, from the gates 23 and 24 are inverted.

Accordingly, in response to the signal D rising to its H level, meaning that the integrated value Wi of the charging current has exceeded the preset value Ws or the magnitude of a charging current has exceeded the preset value Ias, the signal is latched in the latch circuit 43, and when the latching action is terminated by the frequency divider circuit 42, one of the gates 23 and 24 which is selected by the signal from the flipflop 25 changes its output to its H level, thus driving the switching circuit. However, if the signal D fails to assume its H level, the output J assumes its H level when Q11 output from the frequency divider circuit 42 assumes its H level, whereby the flipflop 25 in the switching control circuit 20 is inverted, thus inverting the output levels of signals B and C from the circuit 20. This causes one of the switching circuits 8 and 9 which has been on is commanded to be turned off while the other switching circuit is commanded to be turned on.

The latch circuit 43 delivers the signal K to NOR gate 14 in the current monitor circuit 10, which resets the integrated value across the capacitor Cl in response thereto. When triggered by the signal D of H level, the signal K remains low until the signal H of H level is delivered from the output Q8 of the frequency divider circuit 42, and otherwise remains high.

The construction and the operation of the waveform shaper 35 remains the same as before.

Figure 4:
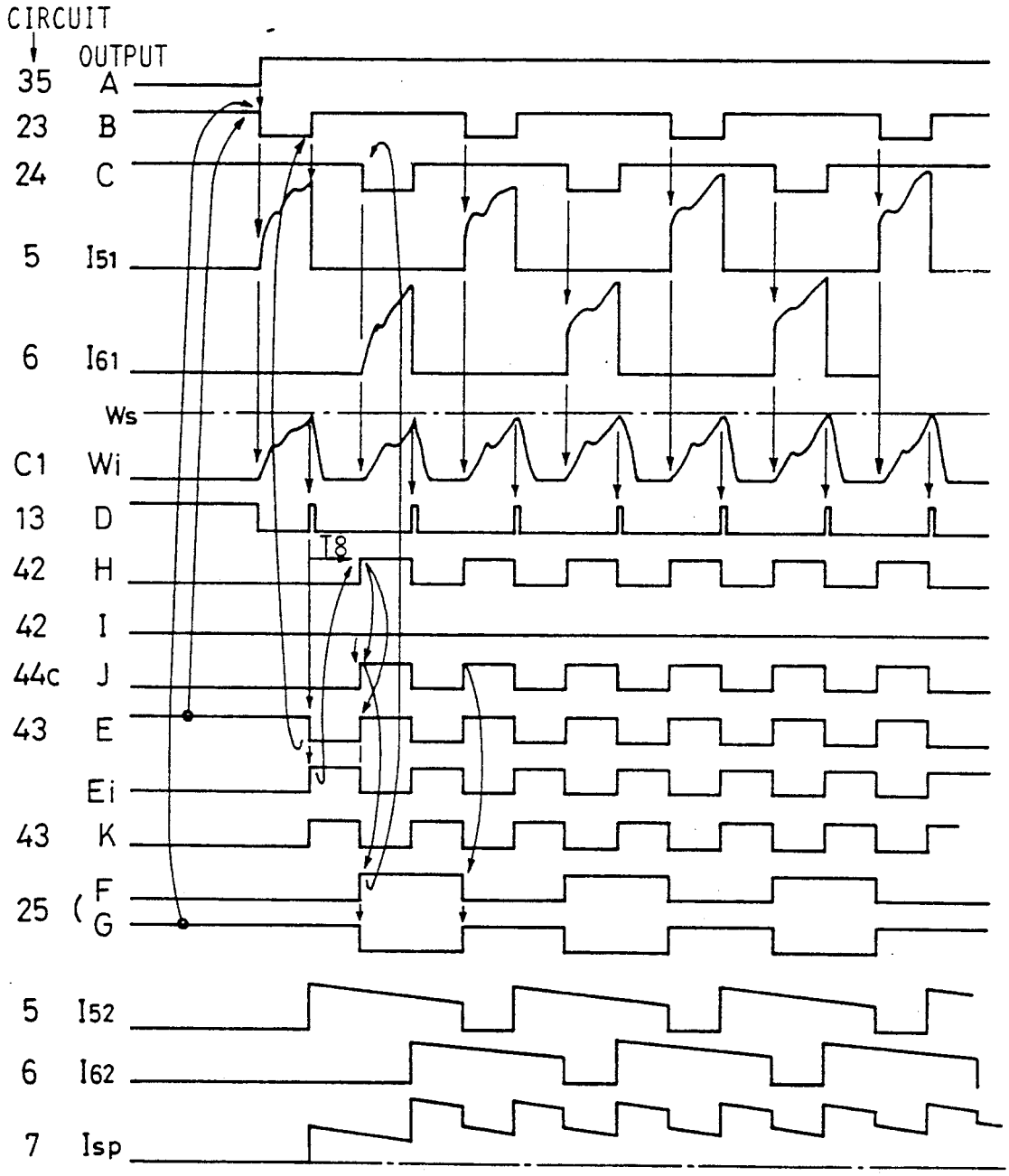
FIG. 4 is a series of timing charts illustrating signals appearing at various parts of the electrical circuit shown in FIG. 3 as a time sequence.

FIG. 4 graphically shows changes occurring in the electrical signals which appear at various points in the electrical circuits shown in FIG. 3, with a common time axis taken on the abscissa. As before, an arrow shown in FIG. 4 indicates the relationship between a change in a signal, located at the origin of the arrow, and a change in another signal, located at the tip of the arrow which is produced in response thereto. By following the progression of arrows starting from the left-most one shown in FIG. 4, the operation of the electrical circuit shown in FIG. 3 can be understood. Specifically, if the engine key switch EKS is closed, when the ignition angle signal A is low, indicating the absence of an ignition command, the outputs B and C from the gates 23 and 24 in the switching control circuit 20 remain both high regardless of the status of the flipflop 25, whereby the switching circuits 8 and 9 are both off. Thus neither ignition coil 5 nor 6 is energized.

Assuming that the flipflop 25 is reset, with its signal K=L and signal L=H, when the ignition angle signal A rises from its L to its H (ignition command) level, the inverted signal E from the Q output from the latch circuit 43 is high. Accordingly, (1) the output B from the gate 23 becomes low to turn the switching circuit 8 on, whereby the charging current $I_{51}$ begins to flow through the primary winding of the ignition coil 5 and continues increasing. The charging current $I_{51}$ (or more strictly, a current proportional thereto) is integrated by the capacitor Cl. When the integrated value Wi exceeds the preset value Ws, the output from the comparator 12 changes from its H to its L level, which causes the output signal D from the gate 13 to rise from its L to its H level, causing the inverted output E from the latch circuit 43 to change from its H level to its L level. The signal D is simultaneously applied to R terminal of the frequency divider circuit 42 as a reset signal.

The frequency divider circuit 42 forms the signal H (Q8 output) and I (Q11 output) having different periods, and starting from the input to its R terminal, on the basis of the clock obtained from the oscillator circuit 31. When the signal H of H level which has a shorter period is delivered, the signal H is NANDed (at 44*b*) with the output Ei (inverted E signal) from the latch circuit 43, and NOR gate 44 delivers the signal J of H level in synchronism with the signal H of H level, thus operating the flipflop 25 in the switching control circuit.

On the other hand, the signal I having a longer period remains unchanged at L level under a normal circuit condition, since the frequency divider circuit 42 is reset by the signal D of H level from the next cycle before the signal I can assume its H level. See later for detailed description.

When the signal D of H level is input to the latch circuit 43, the inverted output signal K therefrom changes from its H to its L level and is input to the gate 14, which therefore causes the transistor 15 to conduct, thus discharging the capacitor Cl. At this time, the output G from the flipflop 25 assumes a low level, whereby the output B from the gate 23 changes from its L level (on command) to its H level (off command), turning the switching circuit 8 off to interrupt the current flow through the primary winding of the ignition coil 5. Thereupon, a high voltage is induced across the secondary winding thereof, producing a spark discharge from the spark plug 7.

When the capacitor Cl discharges, the output of the comparator 12 changes from its L to its H level, and hence the signal D returns to its L level. However, the switching circuit 8 is maintained off since the output E from the latch circuit 43 is maintained at its low level for a time interval T8 until the H signal from the frequency divider circuit 42 assumes its high level.

In response to the rising edge of the signal E from the latch circuit 43, the flipflop 25 inverts, changing its output G to its H level and its output F to its L level. However, the output B from the gate 23 remains unchanged from its H level (switch off). (2) The output C from the gate 24 changes from its H to its L level (switch on), turning the switching circuit 9 on, whereby the charging current $I_{61}$ begins to flow through the primary winding of the ignition coil 6 and continues increasing. The charging current $I_{61}$ is integrated by the capacitor Cl. When the integrated value Wi exceeds the preset value Ws, the output of the comparator 12 changes from its H to its L level, whereby the output signal D from the gate 13 rises from its L to its H level, causing the inverted output E from the latch circuit 43 to change from its H to its L level. At the same time, the signal D of H level is input to R terminal of the frequency divider circuit 42 as a reset signal.

The frequency divider circuit 42 forms the signals H (Q8 output) and I (Q11 output) having different periods, starting from the input of high level to its R terminal, on the basis of the clock obtained from the oscillator circuit 31. When the signal H of high level which has a shorter period is delivered, the signal H is NANDed (at 44*b*) with the output Ei (the inverted E signal) from the latch circuit 43 to cause the gate 44*c* to produce the signal J of H level in synchronism with the signal H of H level, thus switching the flipflop 25 in the switching control circuit 20.

On the other hand, the signal I having a longer period remains low and unchanged under a normal circuit condition, since the signal D of H level for the next cycle is input thereto before it is allowed to become high. See later for detail.

When the signal D of H level is input to the latch circuit 43, the inverted output signal K from the latch circuit 43 changes from its H to its L level, and when it is input to the gate 14, the transistor in the inverter 15 is rendered conductive to discharge the capacitor Cl. At this time, the output F from the flipflop 25 becomes low, and the output C from the gate 24 rises from its L level (on command) to its H level (off command), turning the switching circuit 9 off to interrupt the charging current through the primary winding of the ignition coil 6. Thereupon, a high voltage is induced across the secondary winding thereof, producing a spark discharge from the spark plug 7.

When the capacitor Cl discharges, the output of the comparator 12 returns to its H level from its L level, and the signal D returns to its L level, but the switching circuit 9 is maintained off since the output E from the latch circuit 43 remains low for the time interval T8 until the H signal from the frequency divider circuit 42 becomes high.

In response to the rising edge of the signal E from the latch circuit 43, the flipflop 25 inverts, changing its output F to H level and its output G to L level. The output C from the gate 24 remains unchanged at H level (switch off), and subsequently the operation according to the procedure (1) proceeds. Subsequently, as long as the ignition angle signal A remains high, the operation according to the procedures (1)-(2)-(1)-(2)—and the alternate charging of the ignition coils 5 and 6 are repeated.

When the ignition angle signal A reverts to its L level (no ignition command), the both gates 23 and 24 are disabled, presenting high level outputs B and C, turning the both switching circuits 8 and 9 off to cease the energization of the ignition coils 5 and 6. The output from the gate 14 becomes high to connect the capacitor Cl to the electrical ground, thus resetting the integrated value.

Again in this embodiment, the both ignition coils 5 and 6 may be of a relatively compact size, but the high rate of charging and the high charging voltage allows sufficient charging energy to be supplied to the ignition coil, as mentioned previously. As shown graphically in FIG. 4, the currents $I_{52}$ and $I_{62}$ pass through the spark plug 7 from the secondary winding of either ignition coils 5 and 6, producing a combined effect which is represented by a continuous or uninterrupted current flow, shown at Isp in FIG. 4, through the spark plug 7.

Continuing the description of the operation of the electrical circuit shown in FIG. 3, it is to be noted that any short-circuit or leakage across the terminals or between winding wires of the primary winding of the ignition coil 5 during the operation according to the procedure (1), causes the preset value Ias to be exceeded, whereby the output of the comparator 11 changes from its H to its L level, producing an output from NOR gate 13*a* in the similar manner as when the integrated value Wi across the capacitor Cl exceeds the preset value Ws, triggering the latch circuit 43 and the frequency divider circuit 42 to turn the switching circuit 8 off and inverting the flipflop 25 to transfer into the operation according to the procedure (2). In other words, as soon as the operation according to the procedure (1) is entered, the operation immediately transfers to the operation according to the procedure (2), so that substantially no charging current is fed to the ignition coil 5. In such instance, denoting the charging interval per cycle of the ignition coil 6 by Tc, only the ignition coil 6 will discharge through the spark plug 7 with a period which is substantially equal to T8 +Tc. Thus, isolated spark discharges with pauses therebetween are repeated, and the discharge interval per cycle will be substantially equal to T8.

Assume now that a breakage or an open-circuit across the terminals of the primary winding of the ignition coil 5 has occurred. In the second embodiment, the ignition angle signal A is input to the gate 13*a*, so that the frequency divider circuit 42 is reset when the ignition angle signal A of H level is input or in response to the falling edge of the signal D. The latch circuit 43 operates in response to the rising edge of the signal D of H level which is input to its clock terminal, but does not operate at this time since the signal D which is input to the latch circuit 43 now represents its falling edge. Accordingly, the inverted output signal E from the latch circuit 43 is high, and is input to the gates 23 and 24, operating the switching circuit 8. (3) The operation of the switching circuit 8 acts to initiate the charging of the coil 5, but there is no current flow because of the open-circuit across the terminals. Accordingly, the integrated value Wi cannot reach the preset value Ws, and hence the output of the comparator 12 remains high and unchanged. Therefore, the gate 13*a* cannot produce the trigger signal D of H level in response to the comparator 12. As a result, the latch circuit 43 remains inactive.

The frequency divider circuit 42 produces an output (signal H=H level) after the time interval T8 since the ignition angle signal A of H level is input thereto. However, because the inverted signal of the signal E is low, the output from the gate 44*b* is high and remains unchanged, and accordingly, the signal J also remains low.

Under a normal circuit condition, the signal D is developed with a period which is substantially equal to the coil charging interval Tc + T8 to reset the frequency divider circuit 42 with a corresponding period, but a failure of the occurrence of the signal D of H level causes the frequency divider circuit 42 to produce the signal I of H level from its Q11 output after the time interval Tll has passed since the ignition angle signal A of H level has been input. In response to the signal I, the signal J assumes a high level, whereby the output B from the gate 23 changes to its H level and the output C from the gate 24 changes to its L level. Thus the switching circuit 8 is turned off while the switching circuit 9 is turned off, allowing the coil 6 to be charged. If the coil 6 is normal and non-defective, the operation takes place according to the procedure (2).

Upon completion of the operation according to the procedure (2), the charging of the coil 5 is tried again, but the operation transfers to the operation according to the procedure (3), thus repeating the operation in a sequence of (2)-(3)-(2)-(3)—. However, it is to be noted that during the operation according to the procedure (3) which occurs for the second time and subsequently, the frequency divider circuit 42 produces the output Q11 of H level after the time interval Tll has passed since the occurrence of the signal D of H level during the operation according to the procedure (2). In such instance, denoting the charging interval per cycle of the ignition coil 6 by Tc, only the ignition coil 6 discharges through the spark plug 7 with a period which is substantially equal to T11 + Tc. Thus, isolated spark discharges with pauses therebetween are repeated, and a discharge interval per cycle will be substantially equal to T11.

It is to be understood that logic circuit elements which follows the comparator 11 in the current monitor circuit 10, the switching control circuit 20, the latch circuit 43 and the frequency divider circuit 42 can be functionally replaced by a single or a plurality of microprocessors.

While preferred embodiments of the invention have been illustrated and described, it is to be understood that there is no intention to limit the invention to the precise constructions disclosed herein and a right is reserved to all changes and modification coming within the scope of the invention as defined in the appended claims.

What is claimed is:

1. An ignition system for an internal combustion engine comprising a plurality of ignition coils having their primary windings which have one end connected to a feed bus and having their secondary windings connected in parallel to a spark electrode of an internal combustion engine;

a plurality of switching means for turning ON and OFF the feed path to the primary winding of each of the plurality of ignition coils;

ON command means for applying ON command signal to the switching means selectively and sequentially in a cyclical manner;

integrating means for integrating a current flow through the respective primary winding;

and timing control means for issuing, in response to an integrated value (wi) exceeding a present value (Wi), an OFF command to the ON command means for turning OFF the ON command signal which is being applied to the switching means and resetting the integrated value of the integrating means, and for issuing, after a delay time from the issuing of the OFF command, an ON command to the ON command means, wherein the delay time is predetermined such that while one of the ignition coils is feeding a discharge current to the spark electrode, the switching means connected to the primary winding of the other ignition coil begins to be turned ON and OFF.

2. An ignition system according to claim 1 in which the timing control means issues an OFF command applied to the ON command means, followed by a next ON command which is also applied to the ON command means while resetting the integrated value of the integrating means in response to the magnitude of a current flow through the respective primary winding exceeding a preset value.

3. An ignition system according to claim 1 in which the timing control means issues a next ON command applied to the ON command means when an integrated value by the integrating means remains below a preset value over a given time interval.

4. An ignition system according to claim 2 in which the timing control means issues a next ON command applied to the ON command means when an integrated value by the integrating means remains below a preset value over a given time interval.

5. An ignition system for internal combustion engine comprising

DC/DC converter for boosting a d.c. voltage and delivering it to a feed bus;

a first and a second switching circuit;

a first ignition coil including a primary winding connected between the feed bus and the first switching circuit and a secondary winding connected to a spark electrode of an internal combustion engine;

a second ignition coil including a primary winding connected between the feed bus and the second switching circuit and a secondary winding connected to the spark electrode in parallel with the secondary winding of the first ignition coil;

integrating means for producing a voltage proportional to an integrated value of a current flow through the feed bus;

reset means for clearing the integrated value formed by the integrating means;

current detecting means for producing a voltage proportional to a current flowing through the feed bus;

comparator means for producing a switching signal when the voltage developed by the integrating means reaches a first reference value or when the voltage developed by the current detecting means reaches a second reference value;

and a timing control circuit responsive to the occurrence of an ignition command signal for issuing an ON command signal applied to the first switching circuit and also responsive to the occurrence of the switching signal for issuing a reset signal to the reset means for a given time interval thereafter and for issuing an ON command signal applied to the second switching circuit after the given time interval has passed, the timing control circuit being responsive to the next occurrence of the switching circuit for issuing an OFF command signal applied to the second switching circuit and for issuing a reset signal which is applied to the reset means for a given time interval thereafter and for issuing an ON command signal applied to the first switching circuit after the given time interval has passed, the timing control circuit thus operating to energize the first and the second switching circuit for conduction alternately in response to the occurrence of the switching signal as long as the ignition command signal is present.

6. An ignition system for internal combustion engine comprising

DC/DC converter for boosting a d.c. voltage and delivering it to a feed bus;

a first and a second switching circuit;

a first ignition coil including a primary winding connected between the feed bus and the first switching circuit and a secondary winding connected to a spark electrode of an internal combustion engine;

a second ignition coil including a primary winding connected between the feed bus and the second switching circuit and a secondary winding connected to the spark electrode in parallel with the secondary winding of the first ignition coil;

integrating means for producing a voltage proportional to an integrated value of a current flowing through the feed bus;

reset means for clearing an integrated value formed by the integrating means;

current detecting means for producing a voltage proportional to a current flowing through the feed bus;

comparator means for producing a switching signal when the voltage produced by the integrating means reaches a first reference value or when the voltage produced by the current detecting means reaches a second reference value;

timer means for initiating a timing action in response to the occurrence of an ignition command signal and the occurrence of the switching signal, the timer means operating to produce a time-over signal after a first given time interval since the initiation of the timing action unless the switching signal is produced;

and a timing control circuit responsive to the occurrence of the ignition command signal for issuing an ON command signal applied to the first switching circuit and also responsive to the occurrence of the switching signal for issuing a reset signal which is applied to the reset means for a second given time interval and issuing an ON command signal applied to the second switching circuit after the second given time interval has passed, the timing control circuit being responsive to the next occurrence of the switching signal for issuing an OFF command signal applied to the second switching circuit and issuing a reset signal which is applied to the reset means for the second given time interval thereafter and issuing an ON command signal applied to the first switching circuit after the second given time interval has passed, the timing control circuit thus operating to energize the first and the second switching circuit for conduction alternately in response to the occurrence of the switching signal as long as the ignition command signal is present.

* * * * *